US009704457B2

(12) United States Patent
Martin

(10) Patent No.: US 9,704,457 B2
(45) Date of Patent: Jul. 11, 2017

(54) REVERSE PULL AND DOUBLE DOWN PRESSURE BRIDGE

(71) Applicant: Billy Frank Martin, Fort Myers, FL (US)

(72) Inventor: Billy Frank Martin, Fort Myers, FL (US)

( * ) Notice: Subject to any disclaimer, the term of this patent is extended or adjusted under 35 U.S.C. 154(b) by 0 days.

(21) Appl. No.: 14/997,778

(22) Filed: Jan. 18, 2016

(65) Prior Publication Data

US 2016/0163294 A1 Jun. 9, 2016

Related U.S. Application Data

(63) Continuation-in-part of application No. PCT/IB2015/059384, filed on Dec. 4, 2015.

(60) Provisional application No. 62/087,285, filed on Dec. 4, 2014.

(51) Int. Cl.

| | |
|---|---|
| ***G10D 3/12*** | (2006.01) |
| ***G10D 3/14*** | (2006.01) |
| ***G10D 3/04*** | (2006.01) |
| ***G10D 1/08*** | (2006.01) |
| ***G10D 3/10*** | (2006.01) |

(52) U.S. Cl.

CPC ..... *G10D 3/04* (2013.01); *G10D 1/08* (2013.01); *G10D 3/10* (2013.01); *G10D 3/12* (2013.01)

(58) Field of Classification Search

USPC ..... 84/267

See application file for complete search history.

(56) References Cited

U.S. PATENT DOCUMENTS

| | | | | |
|---|---|---|---|---|
| 5,811,704 | A * | 9/1998 | Anderko | G09B 15/06 84/287 |
| 6,791,022 | B2 * | 9/2004 | Green | G10D 1/085 84/290 |
| 8,217,245 | B1 * | 7/2012 | McKenney | G10D 1/08 84/267 |
| 8,569,602 | B2 * | 10/2013 | Nash | G10D 1/08 84/267 |
| 8,895,824 | B2 * | 11/2014 | Martin | G10D 3/12 84/307 |
| 2005/0235805 | A1 * | 10/2005 | Farris | G10D 1/10 84/269 |
| 2008/0053288 | A1 * | 3/2008 | Brunkalla | G10D 3/02 84/267 |
| 2014/0083275 | A1 * | 3/2014 | Martin | G10D 3/12 84/307 |

* cited by examiner

*Primary Examiner* — Christopher Uhlir

(57) ABSTRACT

A reverse-pull and double-down pressure bridge configuration for a stringed instrument is used to integrate a set of retrofit strings into the instrument. The retrofit strings are tethered between the bridge plate of the instrument and the back end of the instrument so that the retrofit strings are able to apply a reverse pull on a soundboard of the instrument and compress the saddle, the bridge, and the soundboard of the instrument. The retrofit strings are configured to counteract the forward pull applied on the soundboard by the original strings of the instrument.

12 Claims, 8 Drawing Sheets

REVERSE PULL AND DOUBLE DOWN PRESSURE BRIDGE

The current application is a Continuation-In-Part of the Patent Cooperation Treaty application serial number PCT/IB2015/059384, which claims a priority to the U.S. Provisional Patent application Ser. No. 62/087,285 filed on Dec. 4, 2014.

FIELD OF THE INVENTION

The present invention relates generally to an apparatus for a stringed musical instrument bridge. More specifically, the present invention is a reverse-pull and double-down pressure bridge for a stringed instrument.

BACKGROUND OF THE INVENTION

String musical instruments have been around for centuries. The composition of the string instrument includes a number of strings that are stretched over a soundboard that creates enormous amount of tension. When the strings vibrate, a sound is created from the vibration. Oftentimes, a string instrument such as a guitar will become deformed from the tension from the strings. Sometimes, the pulling force of the strings can even pull the bridge off of an acoustic guitar. It is therefore an object of the present invention to introduce an apparatus for a reverse bridge tension design that balances the forward pull and tension created from the strings.

For the present invention, retrofitted strings go over the saddle to the rear of the instrument and relieve or equal the forward pull against the saddle that is caused by the standard strings of the stringed instrument. The present invention also doubles the compression to the saddle, bridge, soundboard and bridge plate that allows the string energy to flow more freely through the soundboard and the bracing of the stringed instrument. The reverse pull felt inside the instrument and felt in front of the saddle from the present invention pulls up towards the rear of the present invention and equals the forward pull of the standard strings. The present invention also floats or is suspended on the top of the soundboard, and the present invention's components allows all parts of the stringed instrument to be more stable and vibrate more freely.

The present invention is different than the apparatus described in U.S. Pat. No. 8,895,824. The apparatus described in U.S. Pat. No. 8,895,824 modifies the path of the standard strings of an instrument to traverse about the back end of the instrument, through the body of the instrument, through the soundboard of the instrument, and then over the saddle of the instrument. However, the present invention mounts retrofit strings onto the instrument in order to generate reverse pull towards the back end of the instrument that counteracts the forward pull of the original strings.

DETAIL DESCRIPTIONS OF THE INVENTION

All illustrations of the drawings are for the purpose of describing selected versions of the present invention and are not intended to limit the scope of the present invention.

Figure 1:
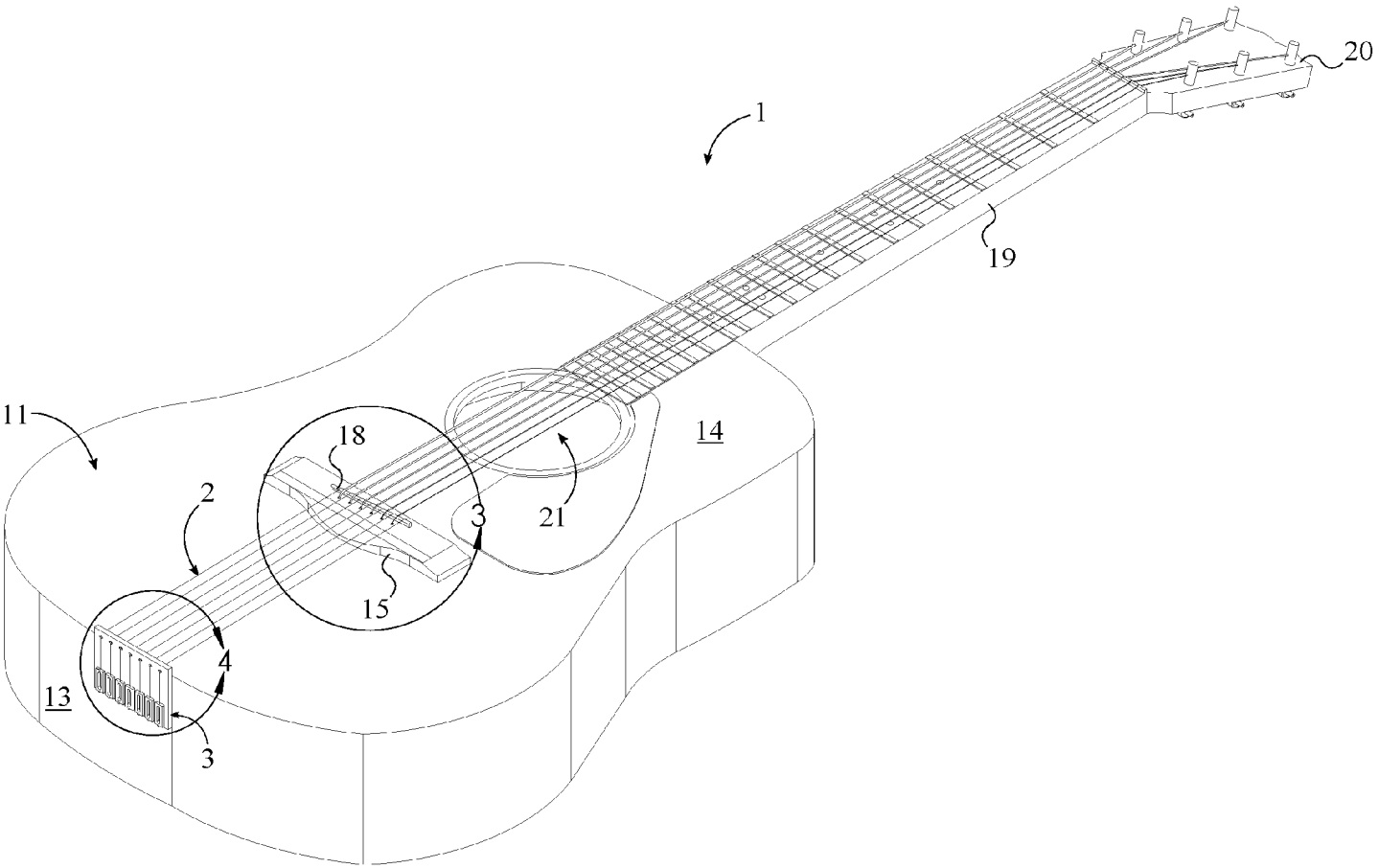
FIG. 1 is a perspective view of present invention and the preferred anchoring mechanism within the stringed instrument.

The present invention is a reverse-pull and double-down pressure bridge configuration for a stringed instrument such as a guitar. The present invention comprises a stringed instrument 1, a plurality of reverse-pull and double-pressure (RPDP) assemblies 2, and a bracket 3. In reference to FIGS. 1 and 2, the preferred embodiment of the present invention is designed to modify and improve an acoustic guitar. However, the present invention can be designed to function with any other types of stringed instrument 1 such as ukulele, cello, and violin. Each of the plurality of RPDP assemblies 2 is a collection of the components that pulls down a saddle 18 of the stringed instrument 1 so that the saddle 18 is able to maintain equilibrium against the upward pressure that is applied by a plurality of standard strings 21 of the stringed instrument 1. The bracket 3 is used to brace the RPDP assemblies 2 against the back of the stringed instrument 1 without damaging the outer surface of the stringed instrument 1.

The present invention modifies specific parts of the stringed instrument 1 in order to properly mount the plurality of RPDP assemblies 2 to the stringed instrument 1 as the stringed instrument 1 can be any instrument that uses tensioned strings to generate sound. In reference to FIG. 1-5, the stringed instrument 1 comprises a body 11, a standard bridge 15, a bridge plate 17, a neck 19, and a headstock 20 in addition to the saddle 18 and the plurality of standard strings 21. The body 11 is used to resonant the vibrations that are produced by the plurality of standard strings 21. The standard bridge 15 is externally connected onto the body 11 so that the standard bridge 15 can be used as the medium to physically transfer the vibrations from the standard bridge 15 to the body 11. The bridge plate 17 structurally stabilizes the standard bridge 15 onto the body 11 and, thus, is internally connected onto the body 11 and positioned adjacent to the standard bridge 15. In addition, the body 11 comprises a front end 12, a back end 13, and a soundboard 14. The soundboard 14 is positioned in between the standard bridge 15 and the bridge plate 17, which allows the soundboard 14 to distribute the vibrations from the plurality of standard strings 21 throughout the rest of the body 11. The soundboard 14 is also positioned perpendicular to both the front end 12 and the back end 13. The neck 19 is adjacently connected to the body 11. The headstock 20 is adjacently connected to the neck 19 and positioned opposite of the body 11, wherein the body 11, the neck 19, and the headstock 20 complete the general shape of the stringed instrument 1. The plurality of standard strings 21 is typically tensioned in between the body 11 and the headstock 20 and positioned over the front end 12 and the neck 19. The back end 13 is typically the butt of the stringed instrument 1. For example, if the stringed instrument 1 is a guitar, then the front end 12 of the body 11 would be adjacent to the neck 19 of the guitar, and the back end 13 would be opposite the neck 19 of the guitar. More specifically, each of the plurality of standard strings 21 is tensionally extended from the standard bridge 15 to the headstock 20 along the neck 19. A tuning key of the stringed instrument 1 is engaged with the corresponding standard string so that the tuning key is able to manually adjust the tension of the corresponding string with the headstock 20. The saddle 18 is used to physically support the plurality of standard strings 21 on the standard bridge 15 so that the plurality of standard strings 21 has adequate space to properly vibrate and can transfer its vibrations to the proper location on the standard bridge 15. Thus, the plurality of standard strings 21 is the mechanical means of producing musical vibrations.

Figure 2:
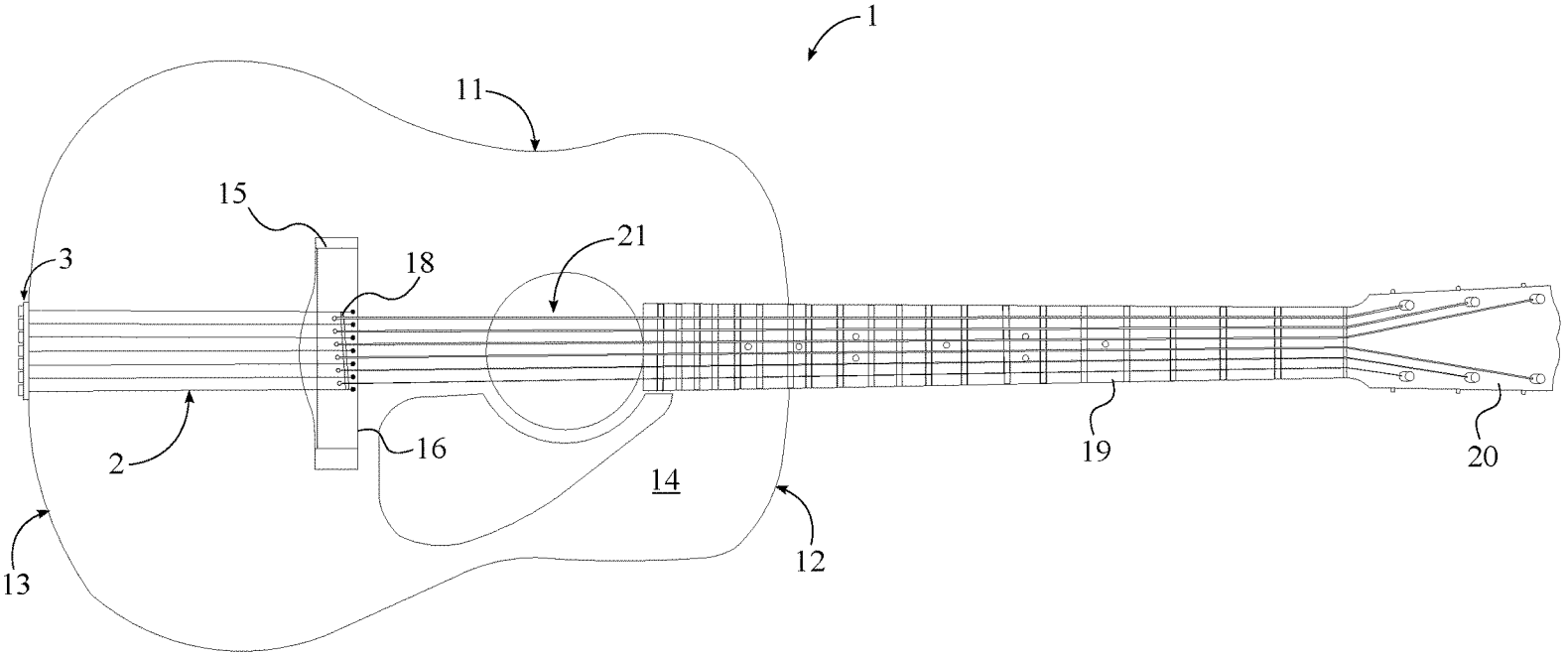
FIG. 2 is a top view of present invention and the preferred anchoring mechanism within the stringed instrument.
Figure 3:
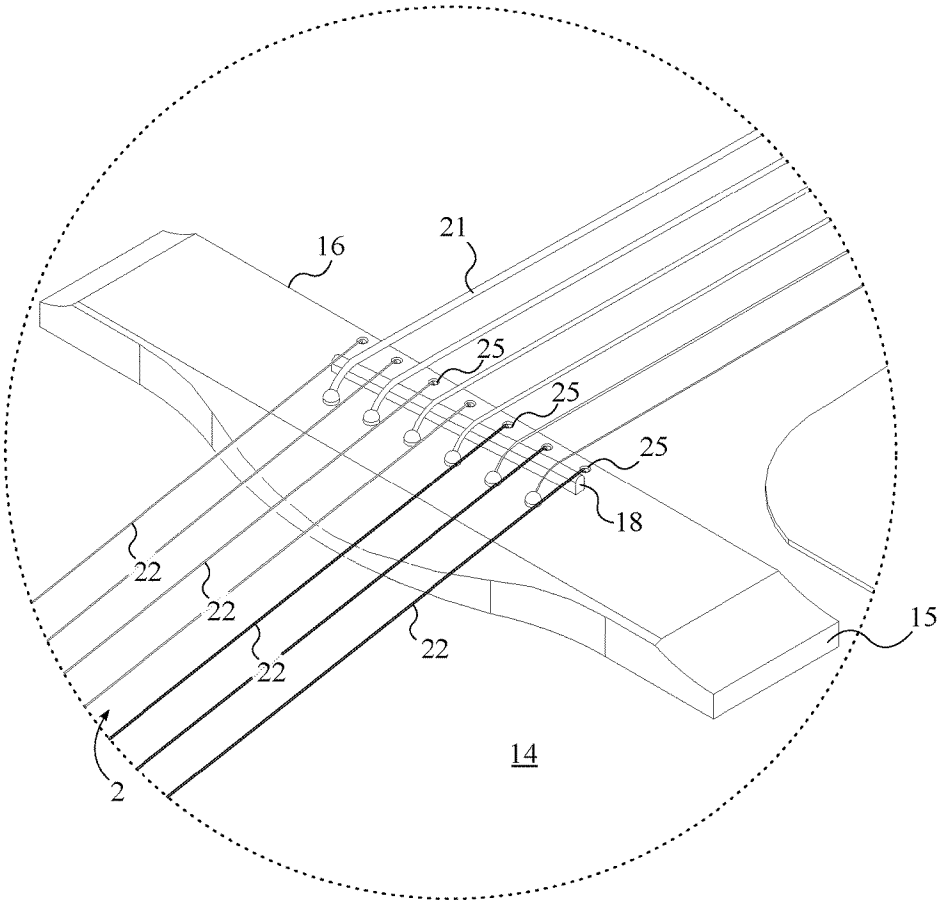
FIG. 3 is a detailed view of the standard bridge of the stringed instrument and the connection of the retrofit strings onto the standard bridge within the present invention.
Figure 4:
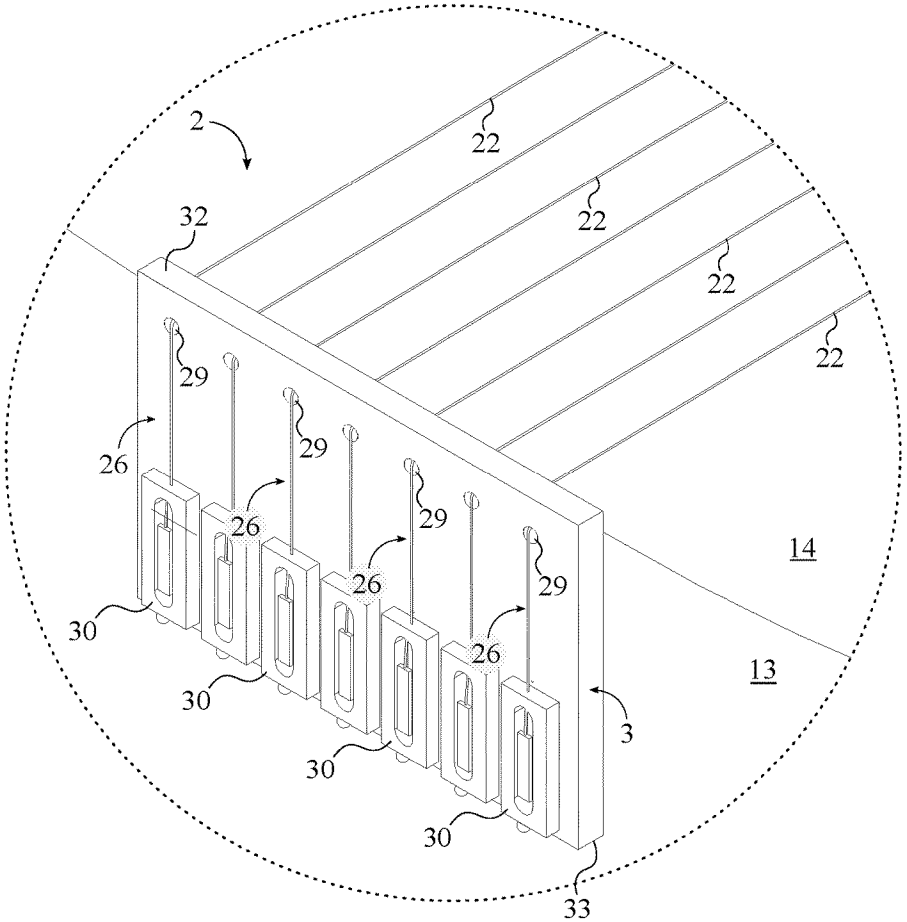
FIG. 4 is a detailed view of the bracket and the connection of the retrofit strings onto the bracket though the preferred anchoring mechanism.
Figure 5:
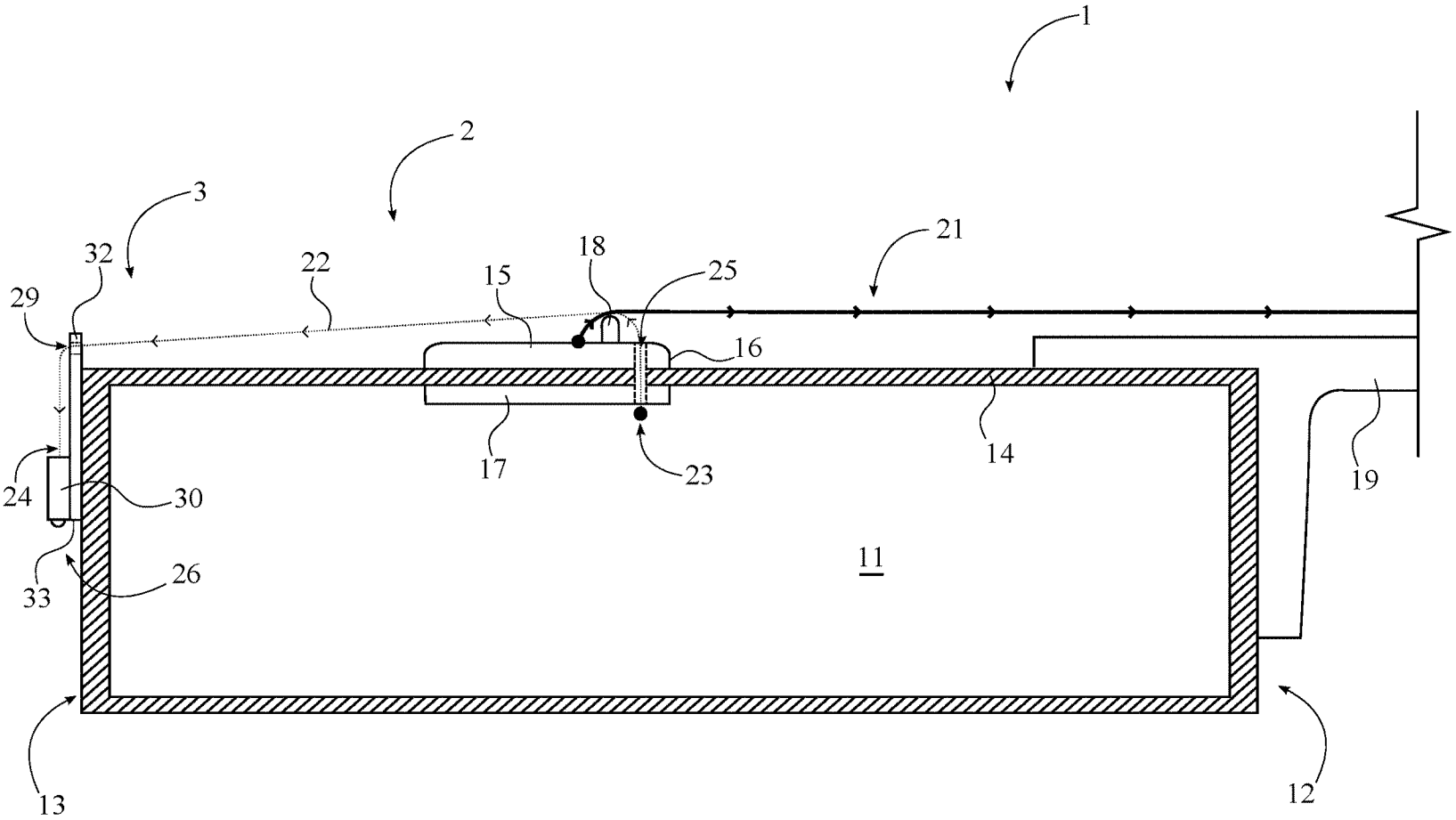
FIG. 5 is a side schematic view showing the configuration of the present invention within the preferred anchoring mechanism.

In reference to FIG. 2, the plurality of RPDP assemblies 2 is evenly spaced across the standard bridge 15 while each of the plurality of RPDP assemblies 2 comprises a retrofit string 22, a sleeve opening 25, and an anchoring mechanism 26. In reference to the general configuration of each RPDP assembly 2, the retrofit string 22 is tensionally extended through the bridge plate 17, the body 11, and the standard bridge 15, around the saddle 18, and into the anchoring mechanism 26. Additionally, each standard string 21 is positioned in between a pair of RPDP assemblies from the plurality of RPDP assemblies 2 so that the each of the plurality of standard strings 21 is able to reach equilibrium without generating moment of force about the saddle 18. In reference to FIG. 5, the bracket 3 is positioned at the back end 13 of the body 11 in order to secure the plurality of RPDP assemblies 2 around the back of the stringed instrument 1. In reference to FIG. 5, the sleeve opening 25 is traversed through the bridge plate 17, the soundboard 14, and the standard bridge 15 as a single component in such a way that the sleeve opening 25 is positioned in between the saddle 18 and a front edge 16 of the standard bridge 15. The anchoring mechanism 26 allows the user to decrease or increase the tension of the retrofit string 22 within the present invention. Depending upon different embodiments of the present invention, configuration and the placement of the anchoring mechanism 26 also changes so that the functionality of the plurality of RPDP assemblies 2 can be optimized. In the preferred embodiment of the present invention, the bracket 3 is a flat metal plate. However, the bracket 3 can be made of different kinds of materials including, but is not limited to, wood, plastic, and composite material.

A preferred embodiment for the anchoring mechanism 26 of the present invention is shown in FIG. 1-5 and comprises a string guide 29 and a tension adjusting anchor 30 as the string guide 29 is integrated onto the bracket 3. More specifically, the bracket 3 is perpendicularly positioned with the soundboard 14 and adjacently connected to with the back end 13 of the stringed instrument 1 to form a ledge 32 of the bracket 3. The ledge 32 provides a protruding surface area for the string guide 29, wherein the string guide 29 is an opening that traverses through the ledge 32. Additionally, the ledge 32 is positioned adjacent to the soundboard 14 while a free edge 33 of the bracket 3 is positioned offset from the soundboard 14. Thus, the bracket 3 properly braces the body 11 while the plurality of RPDP assemblies 2 is tensioned from the bridge plate 17 to the tension adjusting anchor 30. The tension adjusting anchor 30 is a screw engaged to a support member that receives the retrofit string 22 through an external housing. If the screw is rotated in one direction, then the tension adjusting anchor 30 increases the tension felt by the retrofit string 22. If the screw is rotated in the other direction, then the tension adjusting anchor 30 decreases the tension felt by the retrofit string 22. The tension adjusting anchor 30 is adjacently connected to the bracket 3 and positioned opposite of the back end 13. In reference to FIG. 5 that shows the configuration of the preferred embodiment for the anchoring mechanism 26, a first end 23 of the retrofit string 22 is mounted within the sleeve opening 25. More specifically, the first end 23 is adjacently positioned with the bridge plate 17 from the inside of the body 11 so that the retrofit string 22 can be inserted thought the sleeve opening 25 as the sleeve opening 25 extends from the bridge plate 17 to the standard bridge 15. The retrofit string 22 is positioned over the saddle 18 and directed towards the string guide 29 so that the retrofit string 22 is able to extend along the body 11 from the saddle 18 to the back end 13. In order to connect the retrofit string 22 to the tension adjusting anchor 30, the retrofit string 22 is redirected towards the tension adjusting anchor 30 by the string guide 29. A second end 24 of the retrofit string 22 is attached to the tension adjusting anchor 30 so that the user is able to set the appropriate tension of the retrofit string 22 though the tension adjusting anchor 30.

Figure 6:
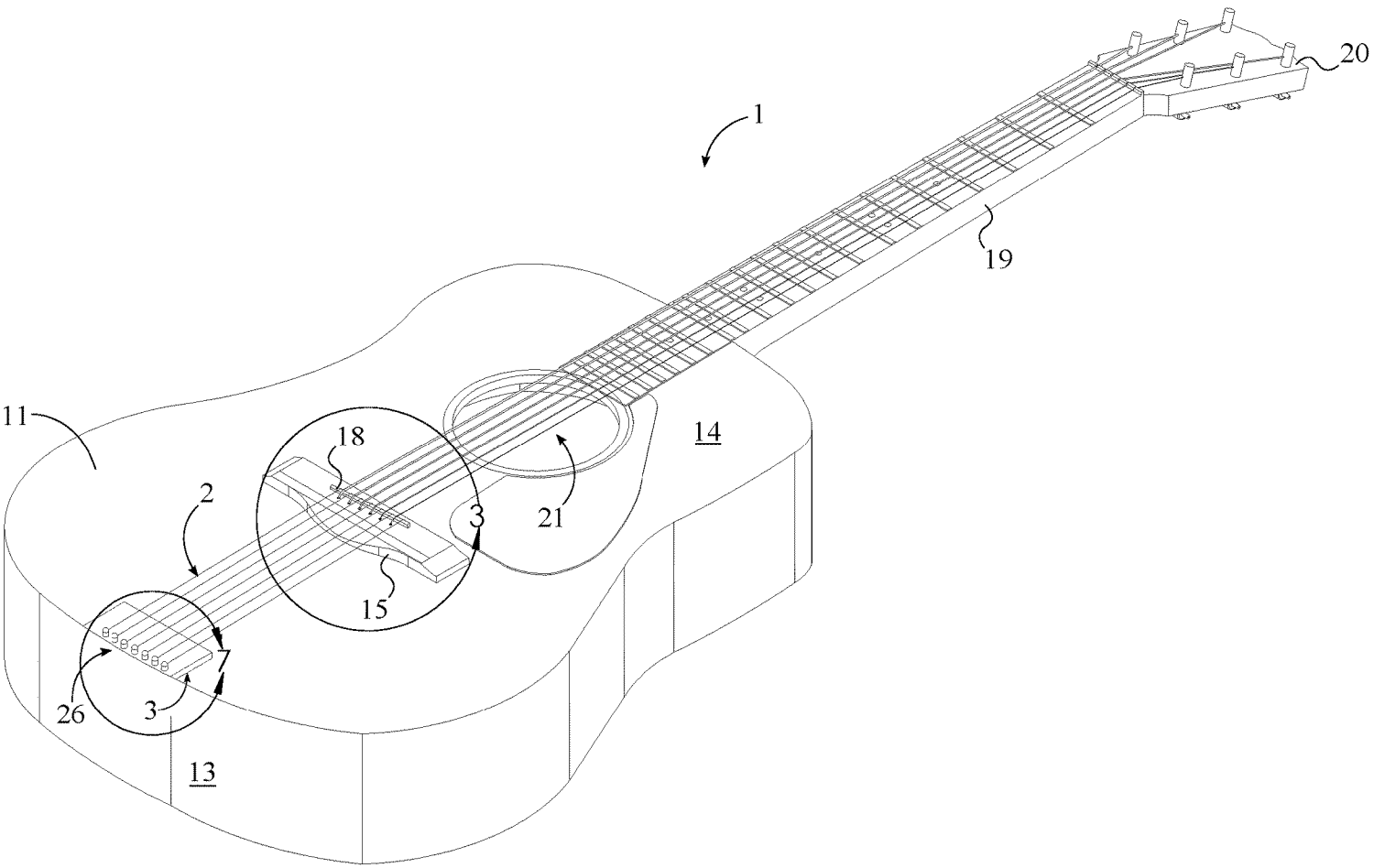
FIG. 6 is a perspective view of present invention and the alternative anchoring mechanism within the stringed instrument.
Figure 7:
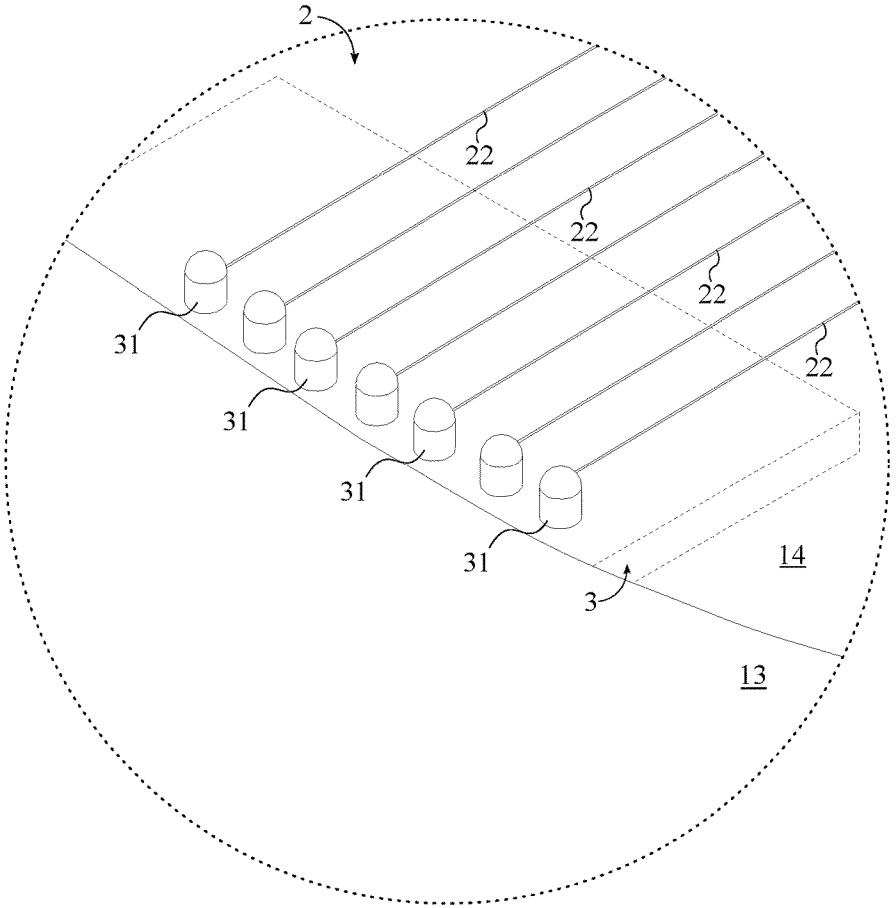
FIG. 7 is a detailed view of the bracket and the connection of the retrofit strings onto the bracket though the alternative anchoring mechanism.
Figure 8:
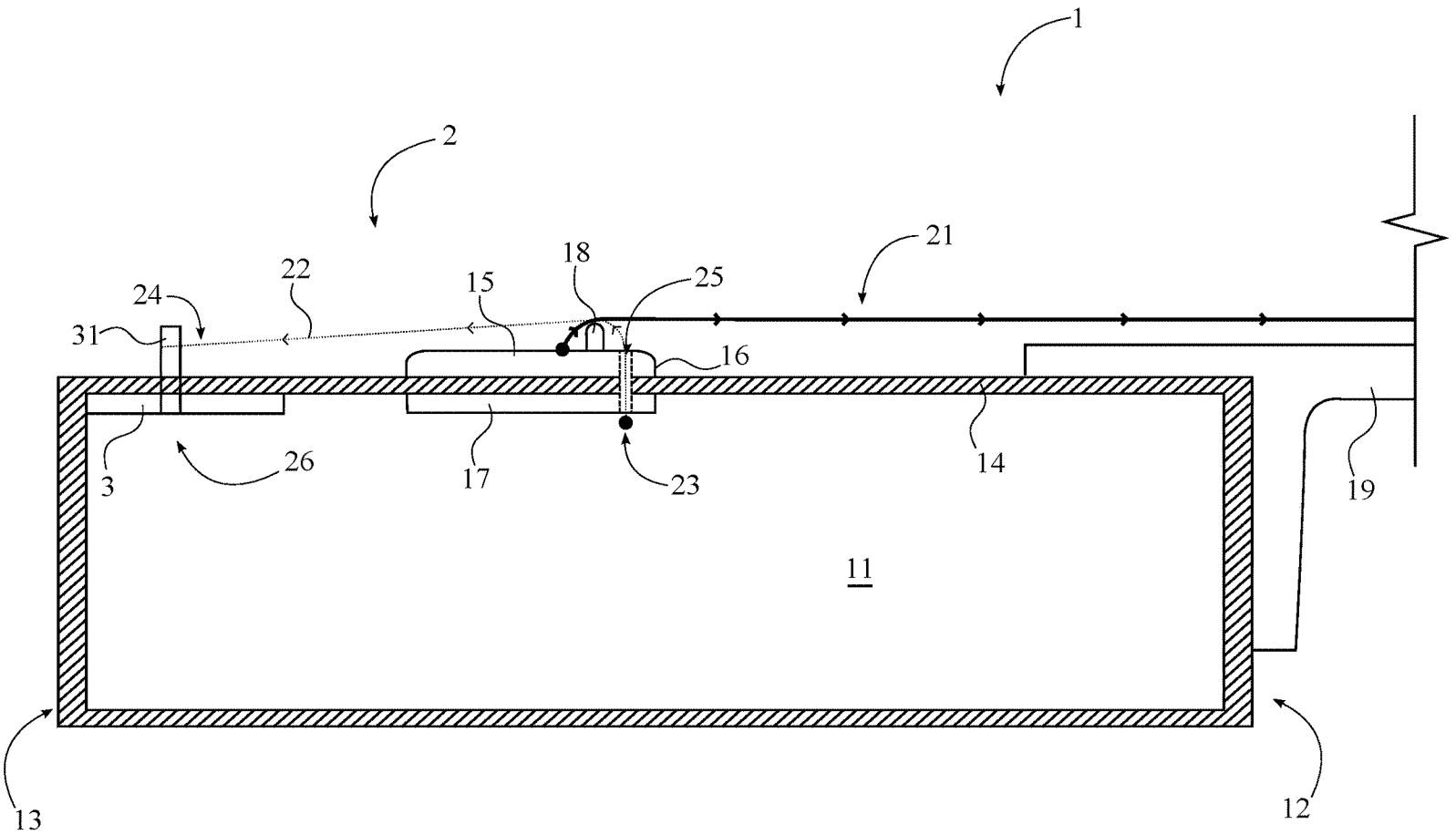
FIG. 8 is a side schematic view showing the configuration of the present invention within the alternative anchoring mechanism.

An alternative embodiment for the anchoring mechanism 26 of the present invention is shown in FIG. 6-8 and comprises a tension tuning pin 31 as the anchoring mechanism 26. The tension tuning pin 31 is connected onto the bracket 3 through the soundboard 14. More specifically, the bracket 3 is positioned parallel with the soundboard 14 and internally connected onto body 11 of the stringed instrument 1 to provide structural support for the tension tuning pin 31. Thus, the bracket 3 properly braces the body 11 while the plurality of RPDP assemblies 2 is tensioned from the bridge plate 17 to the tension tuning pin 31. The tension tuning pin 31 is a rotatable pin that receives the retrofit string 22 within the alternative embodiment of the anchoring mechanism 26. If the tension tuning pin 31 is rotated in one direction, then the tension tuning pin 31 increases the tension felt by the retrofit string 22. If the tension tuning pin 31 is rotated in the other direction, then the tension tuning pin 31 decreases the tension felt by the retrofit string 22. In reference to FIG. 8 that shows the configuration of the alternative embodiment for the anchoring mechanism 26, the first end 23 of the retrofit string 22 is mounted within the sleeve opening 25. More specifically, the first end 23 is adjacently positioned with the bridge plate 17 from the inside of the body 11 so that the retrofit string 22 can be inserted thought the sleeve opening 25 as the sleeve opening 25 extends from the bridge plate 17 to the standard bridge 15. The retrofit string 22 is positioned over the saddle 18 and directed towards the tension tuning pin 31 so that the retrofit string 22 is able to extend along the body 11 from the saddle 18 to the back end 13. In order to connect the retrofit string 22 to the tension tuning pin 31, the second end 24 of the retrofit string 22 is attached to the tension tuning pin 31 so that the user is able to set the appropriate tension of the retrofit string 22 though the tension tuning pin 31.

The present invention relieves or equals the forward pressure felt against the saddle 18 by the plurality of standard strings 21. Simultaneously, the present invention also doubles the downward compression of the saddle 18 onto the standard bridge 15, the soundboard 14, and the bridge plate 17. In addition, the present invention uniformly and upwardly pulls the area of the soundboard 14 that positions between the saddle 18 and the front end 12.

The present invention may also comprise an optional cover plate that mounts over the tension adjusting anchor 30 of the each of the plurality of RPDP assemblies 2 and the bracket 3. The cover plate protects the plurality of RPDP assemblies 2 from any external damages that may happen during the usage of the stringed instrument 1.

Although the invention has been explained in relation to its preferred embodiment, it is to be understood that many other possible modifications and variations can be made without departing from the spirit and scope of the invention as hereinafter claimed.

What is claimed is:

1. A reverse pull and double down pressure bridge for a stringed instrument comprises:

a stringed instrument;

a plurality of reverse-pull and double pressure (RPDP) assemblies;

a bracket;

the stringed instrument comprises a body, a standard bridge, a bridge plate, a saddle, a neck, a headstock, and a plurality of standard strings;

the body comprises a front end, a back end, and a soundboard;

each of the plurality of RPDP assemblies comprises a retrofit string, a sleeve opening, and an anchoring mechanism;

the plurality of RPDP assemblies being evenly spaced with respect to the standard bridge and the soundboard;

the anchoring mechanism being positioned at the back end; and each of the plurality of retrofit strings being tensionally extended through the bridge plate, the body, and the standard bridge, around saddle, and into each of the plurality of anchoring mechanisms by each of the plurality of RPDP assemblies respectively.

2. The reverse pull and double down pressure bridge for a stringed instrument as claimed in claim 1 comprises:

the standard bridge externally connected onto the body;

the bridge plate being internally connected onto the body, adjacent to the standard bridge;

the soundboard being positioned perpendicular to both the front end and the back end;

the soundboard being positioned in between the standard bridge and the bridge plate;

the neck being adjacently connected to the body;

the headstock being adjacently connected to the neck, opposite of the body; and the plurality of standard strings being tensionally extended from the standard bridge to the headstock along the neck.

3. The reverse pull and double down pressure bridge for a stringed instrument as claimed in claim 1 comprises:

each of the plurality of sleeve openings traversing through the bridge plate, the soundboard, and the standard bridge; and each of the plurality of sleeve openings being positioned in between the saddle and a front edge of the standard bridge.

4. The reverse pull and double down pressure bridge for a stringed instrument as claimed in claim 1 comprises:

each of the plurality of anchoring mechanisms being a tension tuning pin;

the bracket being positioned parallel with the soundboard;

the bracket being internally connected onto the body;

the plurality of tension tuning pins being connected to the bracket through the soundboard;

a first end of the retrofit string being adjacently positioned with the bridge plate;

the retrofit string being directed towards the tension tuning pin over the saddle; and a second end of the retrofit string being attached to the tension tuning pin.

5. The reverse pull and double down pressure bridge for a stringed instrument as claimed in claim 1, wherein each standard string is positioned in between a pair of RPDP assemblies from the plurality of RPDP assemblies.

6. A reverse pull and double down pressure bridge for a stringed instrument comprises:

a stringed instrument;

a plurality of reverse-pull and double pressure (RPDP) assemblies;

a bracket;

the stringed instrument comprises a body, a standard bridge, a bridge plate, a saddle, a neck, a headstock, and a plurality of standard strings;

the body comprises a front end, a back end, and a soundboard;

each of the plurality of RPDP assemblies comprises a retrofit string, a sleeve opening, and an anchoring mechanism;

each of the plurality of sleeve openings traversing through the bridge plate, the soundboard, and the standard bridge;

each of the plurality of sleeve openings being positioned in between the saddle and a front edge of the standard bridge;

the plurality of RPDP assemblies being evenly spaced with respect to the standard bridge and the soundboard;

the anchoring mechanism being positioned at the back end; and each of the plurality of retrofit strings being tensionally extended through each of the plurality of sleeve openings and into each of the plurality of anchoring mechanisms by each of the plurality of RPDP assemblies respectively.

7. The reverse pull and double down pressure bridge for a stringed instrument as claimed in claim 6 comprises:

the standard bridge externally connected onto the body;

the bridge plate being internally connected onto the body, adjacent to the standard bridge;

the soundboard being positioned perpendicular to both the front end and the back end;

the soundboard being positioned in between the standard bridge and the bridge plate;

the neck being adjacently connected to the body;

the headstock being adjacently connected to the neck, opposite of the body; and the plurality of standard strings being tensionally extended from the standard bridge to the headstock along the neck.

8. The reverse pull and double down pressure bridge for a stringed instrument as claimed in claim 6 comprises:

each of the plurality of anchoring mechanisms being a tension tuning pin;

the bracket being positioned parallel with the soundboard;

the bracket being internally connected onto the body;

the plurality of tension tuning pins being connected to the bracket through the soundboard;

a first end of the retrofit string being adjacently positioned with the bridge plate;

the retrofit string being directed towards the tension tuning pin over the saddle; and a second end of the retrofit string being attached to the tension tuning pin.

9. The reverse pull and double down pressure bridge for a stringed instrument as claimed in claim 6, wherein each standard string is positioned in between a pair of RPDP assemblies from the plurality of RPDP assemblies.

10. A reverse pull and double down pressure bridge for a stringed instrument comprises:

a stringed instrument;

a plurality of reverse-pull and double pressure (RPDP) assemblies;

a bracket;

the stringed instrument comprises a body, a standard bridge, a bridge plate, a saddle, a neck, a headstock, and a plurality of standard strings;

the body comprises a front end, a back end, and a soundboard;

each of the plurality of RPDP assemblies comprises a retrofit string, a sleeve opening, and an anchoring mechanism;

each of the plurality of sleeve openings traversing through the bridge plate, the soundboard, and the standard bridge;

each of the plurality of sleeve openings being positioned in between the saddle and a front edge of the standard bridge;

the plurality of RPDP assemblies being evenly spaced with respect to the standard bridge and the soundboard;

the anchoring mechanism being positioned at the back end;

each of the plurality of retrofit strings being tensionally extended through each of the plurality of sleeve openings and into each of the plurality of anchoring mechanisms by each of the plurality of RPDP assemblies respectively; and each standard string is positioned in between a pair of RPDP assemblies from the plurality of RPDP assemblies.

11. The reverse pull and double down pressure bridge for a stringed instrument as claimed in claim 10 comprises:

the standard bridge externally connected onto the body;

the bridge plate being internally connected onto the body, adjacent to the standard bridge;

the soundboard being positioned perpendicular to both the front end and the back end;

the soundboard being positioned in between the standard bridge and the bridge plate;

the neck being adjacently connected to the body;

the headstock being adjacently connected to the neck, opposite of the body; and the plurality of standard strings being tensionally extended from the standard bridge to the headstock along the neck.

12. The reverse pull and double down pressure bridge for a stringed instrument as claimed in claim 10 comprises:

each of the plurality of anchoring mechanisms being a tension tuning pin;

the bracket being positioned parallel with the soundboard;

the bracket being internally connected onto the body;

the plurality of tension tuning pins being connected to the bracket through the soundboard;

a first end of the retrofit string being adjacently positioned with the bridge plate;

the retrofit string being directed towards the tension tuning pin over the saddle; and a second end of the retrofit string being attached to the tension tuning pin.

* * * * *